US009190038B2

(12) United States Patent
Jensen et al.

(10) Patent No.: US 9,190,038 B2
(45) Date of Patent: Nov. 17, 2015

(54) TENSION ADJUSTMENT HOOP FOR A MEMBRANE OF A MUSICAL INSTRUMENT

(71) Applicants: Dan Jensen, Egå (DK); Helle Dannemand Pedersen, Egå (DK)

(72) Inventors: Dan Jensen, Egå (DK); Helle Dannemand Pedersen, Egå (DK)

( * ) Notice: Subject to any disclaimer, the term of this patent is extended or adjusted under 35 U.S.C. 154(b) by 0 days.

(21) Appl. No.: 14/351,102

(22) PCT Filed: Oct. 11, 2012

(86) PCT No.: PCT/DK2012/000111
§ 371 (c)(1),
(2) Date: Apr. 10, 2014

(87) PCT Pub. No.: WO2013/053358
PCT Pub. Date: Apr. 18, 2013

(65) Prior Publication Data

US 2014/0238218 A1 Aug. 28, 2014

(30) Foreign Application Priority Data

Oct. 11, 2011 (DK) ..... 2011 00788

(51) Int. Cl.
*G10D 13/02* (2006.01)
*G10D 1/10* (2006.01)
*G10D 13/04* (2006.01)

(52) U.S. Cl.
CPC ..... *G10D 13/023* (2013.01); *G10D 1/10* (2013.01); *G10D 13/025* (2013.01); *G10D 13/04* (2013.01)

(58) Field of Classification Search
USPC ..... 84/413
See application file for complete search history.

(56) References Cited

U.S. PATENT DOCUMENTS 4,520,709 A * 6/1985 Kester, Jr. ..... 84/415
4,831,912 A * 5/1989 Allen ..... 84/419

(Continued)

FOREIGN PATENT DOCUMENTS

DE 2754048 A1 7/1978
GB 589617 A 6/1947

(Continued)

OTHER PUBLICATIONS

International Search Report from PCT/DK2012/000111, Oct. 1, 2013, WO.

*Primary Examiner* — Christopher Uhlir
(74) *Attorney, Agent, or Firm* — Lempia Summerfield Katz LLC

(57) ABSTRACT

A tension adjustment hoop (1) for tensioning a resonant skin (13) on a musical instrument (6, 25), the tension adjustment hoop (1) being formed by a ring (2) with a center axis (3) and with retention means (4) arranged to interact with coupling means (5) on the musical instrument (6, 25) for retention of the tension adjustment hoop (1), the tension adjustment hoop (1) having an opposing top side (7) and bottom side (8), where the tension adjustment hoop (1) comprises an inner fluid channel (17), provided with a pressure adjustment connection (26) in hydraulic connection with the fluid channel (17), and a plurality of pistons (10), each in hydraulic connection with the fluid channel (17), each with a free end (11) opposite the fluid channel (17), and each, under the influence of the pressure in the fluid channel (17), being displaceable in a direction parallel to the center axis (3) of the tension adjustment hoop (1) between a first extreme position, where the free end (11) is within or level with the bottom side (8), and a second extreme position, where the free end (11) is outside the bottom side (8).

9 Claims, 10 Drawing Sheets

(56) References Cited

U.S. PATENT DOCUMENTS

| | | | | |
|---|---|---|---|---|
| 5,427,009 | A | 6/1995 | LaPlante | |
| 2002/0029680 | A1* | 3/2002 | Cleland | 84/411 R |
| 2012/0227569 | A1* | 9/2012 | Koks | 84/413 |
| 2013/0152765 | A1* | 6/2013 | Morita et al. | 84/413 |

FOREIGN PATENT DOCUMENTS

| | | | |
|---|---|---|---|
| WO | WO95/28698 | A1 | 10/1995 |
| WO | WO2007/144706 | A1 | 12/2007 |

* cited by examiner

Section A-A

Section A-A

Section B-B

Section C-C

TENSION ADJUSTMENT HOOP FOR A MEMBRANE OF A MUSICAL INSTRUMENT

RELATED APPLICATION DATA

This U.S. national phase application is based on International Application Serial No. PCT/DK2012/000111 filed on Oct. 11, 2012, which claimed priority to Danish Patent Application No. PA 2011 00788 filed on Oct. 11, 2011. Priority benefit of each of these earlier filed applications is hereby claimed, and the full disclosures of each of these earlier filed applications are hereby incorporated by reference herein.

FIELD OF THE INVENTION

A tension adjustment hoop for tensioning a resonant skin on a musical instrument, the tension adjustment hoop being formed by a ring with a centre axis and with retention means arranged to interact with coupling means on the musical instrument for retention of the tension adjustment hoop, the tension adjustment hoop having an opposing top and bottom side.

The invention furthermore relates to a method for tensioning a drumhead and the use of a tension adjustment hoop.

BACKGROUND OF THE INVENTION

Various musical instruments exist which use a resonant skin to produce sound waves characteristic to the individual instrument. Examples of such instruments are various percussion instruments and banjos.

A resonant skin comprises a skin which may be organic or synthetic. The skin is attached to a ring, which may be e.g. a metal ring.

The musical instruments comprise a shell with an end edge. The resonant skin is placed on the shell with the skin abutting the end edge. The ring is configured with a size to enclose the shell. The pitch produced by the resonant skin is dependent on how tightly the skin is tensioned. The tensioning of the skin can be adjusted by displacing the ring parallel to a centre axis through the shell, so that the skin is pressed with more or less force against the end edge, tensioning the skin to a larger or smaller degree. The tighter the tensioning, the higher the pitch.

The degree to which the skin must be tensioned to achieve a given pitch is dependent on several different parameters, for instance room temperature, air pressure and air humidity. Therefore, the distance of ring displacement relative to the shell to achieve a given pitch may vary.

For tensioning the skin, a tension adjustment hoop is used, which is placed on top of the resonant skin, so that the resonant skin is between the shell and the tension adjustment hoop. The tension adjustment hoop is connected to tensioning means, which may be attached to the shell, and which may be adjustable, so that the tension adjustment hoop is displaceable relative to the shell for tensioning the resonant skin. On a drum or a banjo, the tensioning means will be evenly distributed around the periphery of the shell to ensure even tensioning.

A musician tunes the instrument by adjusting the pitch before the musician starts playing. During play, it may be necessary to make several minor adjustments. The time consumption for tuning the instrument is largely dependent on the number of tensioning means, whereas the number of tensioning means in turn influences the sound quality produced by the instrument. A compromise is consequently made between the amount of time available to the musician for tuning the instrument during e.g. a concert and the desired sound quality.

Commonly known resonant skins consist of a synthetic skin provided with a welded-on ring, forming a dolly when tensioning the skin. The ring is designed to be flexible relative to its planeness to enable fine-tuning of the resonant skin. When tensioning and commencing use of a new resonant skin, the ring of the skin may be deformed relative to its original shape. During this process, crunching sounds will typically be emitted from the welding. When using the commonly known tuning method, the planeness or deformation of the ring is of minor importance, as the tensioning means are adjusted individually by hand until the desired note is achieved. However, this tuning method is cumbersome and time-consuming. Therefore, previous attempts have been made to invent mechanically and hydraulically acting systems to alleviate this process.

The problems relating to the prior systems are, to a large extent, caused by the fact that their power transfer means, which abuts the ring of the resonant skin, is provided as a coherent circular ring 30 (FIG. 8A), embodied as a tension adjustment hoop, ring or tube. This embodiment of the pressure means would not be able to transfer a sufficient, evenly distributed torque to the ring of the resonant skin 15 (FIG. 8A).

For instance, WO 95/28698 A1 (Martin) 1995-10-26 describes a circular tube located under a tension adjustment hoop. For instance, WO 2007/144706 A2 (CASTAGNA), describes a frame in which a rigid circular ring is pressed against the resonant skin from the inner side. For instance, U.S. Pat. No. 1,054,009 Feb. 25, 1913 (William F. Ludwig) describes different variations of examples 1 and 2.

These examples have the problematic common feature that the power transfer to the ring of the resonant skin is a coherent circular force F (see FIG. 8A).

OBJECT OF THE INVENTION

The object of the invention is to provide a tension adjustment hoop enabling quick and even pitch adjustment of a resonant skin on a musical instrument.

DESCRIPTION OF THE INVENTION

A tension adjustment hoop for tensioning the resonant skin on a musical instrument, the tension adjustment hoop being formed by a ring with a centre axis and with retention means arranged to interact with coupling means on the musical instrument for retention of the tension adjustment hoop, the tension adjustment hoop having an opposing top and bottom side, the tension adjustment hoop being characterised in that it comprises an inner fluid channel, provided with a pressure adjustment connection in hydraulic connection with the fluid channel, and a plurality of pistons, each in hydraulic connection with the fluid channel, each having a free end abutting the ring of the resonant skin (see FIG. 8B), and each, under the influence of the pressure in the fluid channel, being displaceable in a direction parallel to the centre axis of the tension adjustment hoop between a first extreme position, where the free end is level with the bottom side, and a second extreme position, where the free end is outside the bottom side.

This is furthermore achieved according to a method for tensioning a drumhead using a tension adjustment hoop according to the invention, the method comprising the following steps:

mounting the tension adjustment hoop on the musical instrument;

coupling the retention means to the coupling means on the musical instrument;

adjusting the pressure in the fluid channel to adjust the pitch.

This provides for a tension adjustment hoop enabling quick and even adjustment of the pitch of a resonant skin on a musical instrument, the free ends of the pistons abutting the ring of the resonant skin and influencing said ring with uniform pressure throughout the periphery of the ring, the pistons all being in hydraulic connection with the fluid channel, in which the pressure is adjusted centrally through the pressure adjustment connection. The musician is therefore not required to make adjustments in more than one place.

A further advantage of this invention is that the tension adjustment hoop is not critical as regards tolerance and inaccuracies in the ring of the resonant skin, as the pistons will influence the ring with uniform pressure, regardless of travel, to achieve said pressure.

The pistons are evenly distributed in cylinders along the circumference of the tension adjustment hoop. The pistons may be more or less closely spaced, depending on their number.

Examples of musical instruments could be e.g. a drum or a banjo.

The musical instrument is of a type comprising a shell with an end edge, and the resonant skin is of a type comprising a skin mounted on a ring. The resonant skin is mounted between the tension adjustment hoop and the shell with the skin abutting the end edge of the shell.

The tension adjustment hoop is attached to the shell by means of an interconnection between the retention means on the tension adjustment hoop and the coupling means on the shell. Said interconnection prevents displacement of the tension adjustment hoop in relation to the shell, both in the axial direction and in a plane parallel to the end edge of the shell.

Typically, the coupling means will be adjustable to enable initial adjustment of the ring of the resonant skin so that it is aligned in relation to the end edge of the shell. By alignment is thus meant that the tensioning against the end edge of the shell is even.

During this initial adjustment, the bottom side of the tension adjustment hoop will typically abut the ring of the resonant skin. Adjustment of the pitch can now be performed by adjusting the pressure in the fluid channel. For instance, the pressure in the fluid channel could be increased. The pistons are thus displaced under influence of the pressure in the fluid channel from their first extreme position towards a second extreme position with their free end outside the bottom side of the tension adjustment hoop and abutting the ring of the resonant skin, so that the skin is tensioned and the pitch changes.

The tension adjustment hoop can be readily dimensioned and formed to replace known tension adjustment hoops arranged for tensioning a resonant skin abutting an end edge of the shell of a musical instrument. It is therefore unnecessary to make any modification of the musical instrument by using the tension adjustment hoop according to the invention, and the musical instrument can be returned to its initial condition by dismounting the tension adjustment hoop according to the invention and mounting the known tension adjustment hoop.

According to a further embodiment, the tension adjustment hoop according to the invention is characterised in that the tension adjustment hoop comprises a flange and in that the retention means are formed through openings in the flange.

A particularly simple way of providing the retention means is thus achieved. Furthermore, tension adjustment hoops on known drums can readily be exchanged for the tension adjustment hoop according to the invention, as the coupling means on known drums may be formed so as to interact with retention means in the form of openings.

According to an alternative embodiment, the tension adjustment hoop according to the invention is characterised in that the retention means are provided with abutment surfaces.

The abutment surfaces are arranged for abutment with coupling means on the musical instrument, which could be e.g. hooks.

According to a further embodiment, the tension adjustment hoop according to the invention is characterised in that the tension adjustment hoop comprises pressure adjustment means in connection with the pressure adjustment connection for adjustment of the pressure in the fluid channel.

It is thus achieved that adjustment of the pressure can be performed centrally.

The pressure adjustment means may be mounted directly on the tension adjustment hoop and connected directly to the pressure adjustment connection.

This makes it simple to adjust the pressure in the fluid channel.

The pressure adjustment means may be located separately from the tension adjustment hoop and connected to the pressure adjustment connection through a channel, e.g. a line, tube or hose.

This makes it possible to connect the pressure adjustment means to an actuation part which can be operated while the musician is playing. For instance, the actuating part may be a foot pedal, a knee pedal, a manually operated unit, an arm-operated unit, a mouth-operated unit or an electrically, pneumatically or hydraulically driven unit.

The pressure adjustment means may form part of a larger actuation arrangement, in which several tension adjustment hoops are connected to the actuation arrangement, enabling joint or individual operation of said tension adjustment hoops. This enables a drummer, having a drum set with several drums, to adjust, in a simple way, the pitch of one or more of the drums in the drum set during playing.

According to a further embodiment, the tension adjustment hoop according to the invention is characterised in that the pressure adjustment means comprises a pressure adjustment piston displaceably mounted in a piston housing with an adjustment volume, the pressure adjustment piston being displaceable between a first adjustment position and a second adjustment position, where the adjustment volume is the largest with the pressure adjustment piston in its first adjustment position, and where the adjustment volume is the smallest with the pressure adjustment piston in its second adjustment position.

A particularly simple way of providing the pressure adjustment means is thus achieved. The adjustment volume is dimensioned with consideration to the volume of the fluid channel, the desired piston travel and the properties of the resonant skin.

According to a further embodiment, the tension adjustment hoop according to the invention is characterised in that the pressure adjustment means comprises a threaded actuating part for displacement of the pressure adjustment piston.

A particularly simple way of performing adjustment using the pressure adjustment means is thus achieved, the thread establishing an exchange in relation to the forces of the adjustment volume and the fluid channel, making it possible to establish a high pressure in the fluid channel without having to influence the actuating part with large forces.

A further advantage of using a thread may be obtained by selecting the thread pitch to make the actuating part self-locking, thus requiring no additional means to avoid gradual loss of pressure in the fluid channel.

According to a further embodiment, the tension adjustment hoop may be provided with a pressure gauge, enabling the musician to visually see whether the musical instrument is in tune. The pressure gauge may be an integrated part of the pressure adjustment means.

The tension adjustment hoop can be used for tensioning a resonant skin on a percussion instrument. A percussion instrument may be e.g. a drum or a tympani.

The tension adjustment hoop can be used for tensioning a resonant skin on a string instrument. A string instrument may be e.g. a banjo.

DESCRIPTION OF THE DRAWINGS

The invention will now be described in detail with reference to the accompanying drawings, in which.

In the description of the figures, identical or corresponding elements will be designated by the same references in the various figures. An explanation of all details in connection with each figure/embodiment will thus not be given.

DETAILED DESCRIPTION OF THE INVENTION

Figure 1:
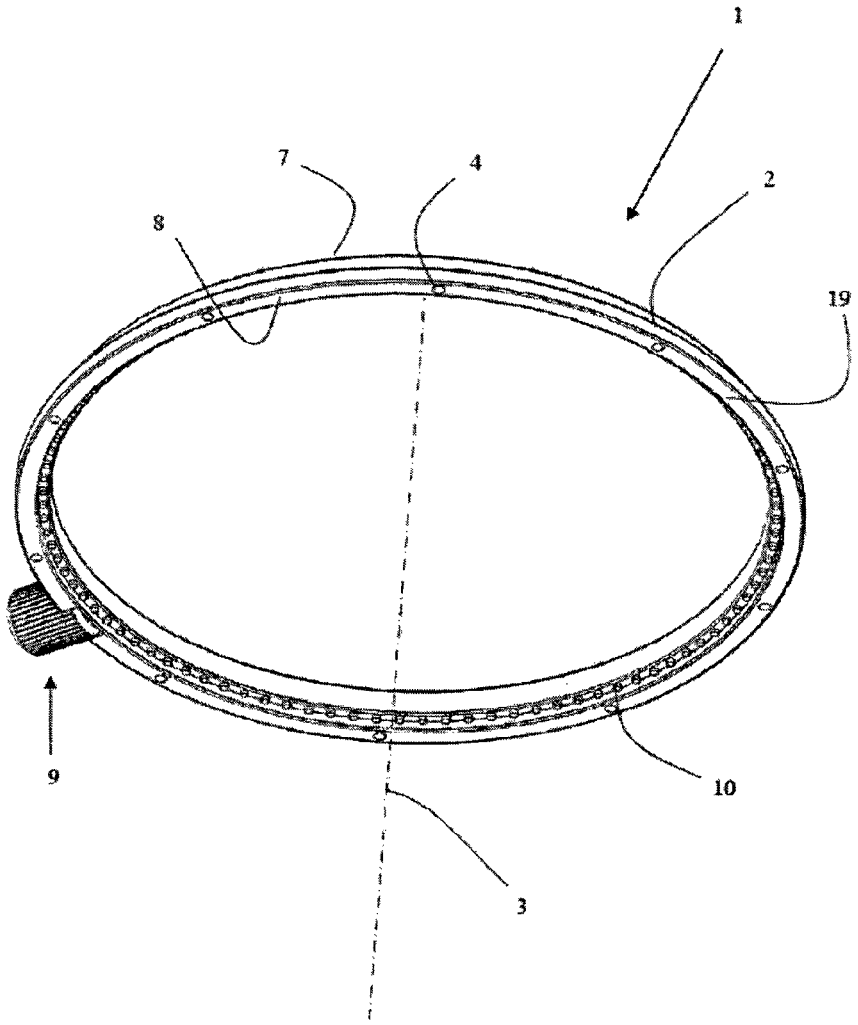
FIG. 1 shows an isometric view of a tension adjustment hoop according to the invention.

FIG. 1 shows an isometric view of a tension adjustment hoop 1 according to the invention.

The tension adjustment hoop 1 is formed by a ring 2 with a centre axis 3. In the embodiment shown, the ring 2 is circular. The ring 2 has retention means 4 arranged for interaction with coupling means 5 (see FIG. 2) on a drum 6 (see FIG. 2). The tension adjustment hoop 1 in the embodiment shown in FIG. 1 has ten retention means 4. The number of retention means 4 typically depends on the number of coupling means 5 on the existing musical instrument.

The tension adjustment hoop 1 has a top side 7 and a bottom side 8. Furthermore, the tension adjustment hoop 1 has a pressure adjustment means 9 and a plurality of pistons 10, which have a free end 11 rising from the bottom side 8 during displacement of the pistons 10 in a direction parallel to the centre axis 3 of the tension adjustment hoop from their first extreme position towards their second extreme position.

Figure 9:
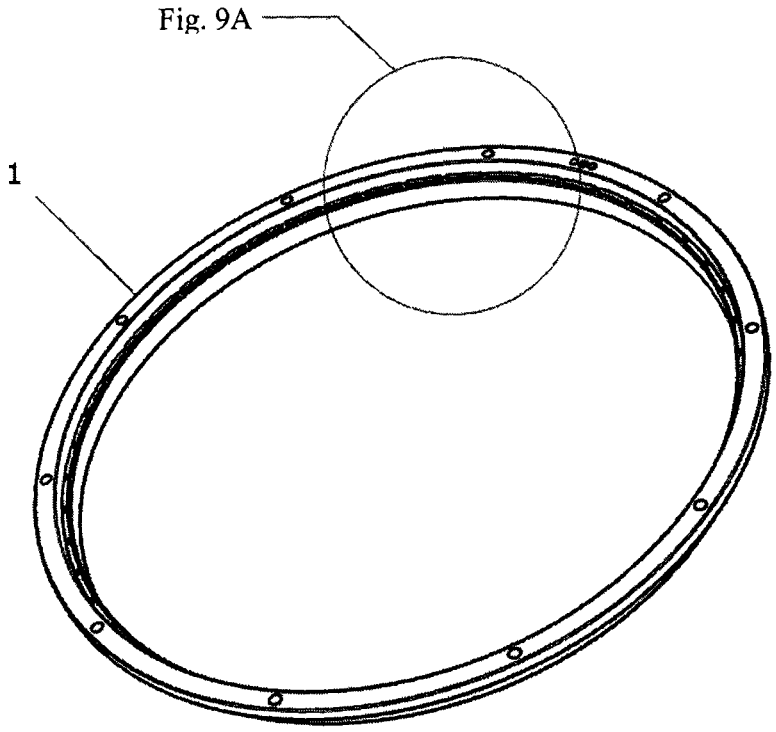
FIG. 9 shows a tension adjustment hoop with an alternative embodiment of piston 10.
Figure 9A:
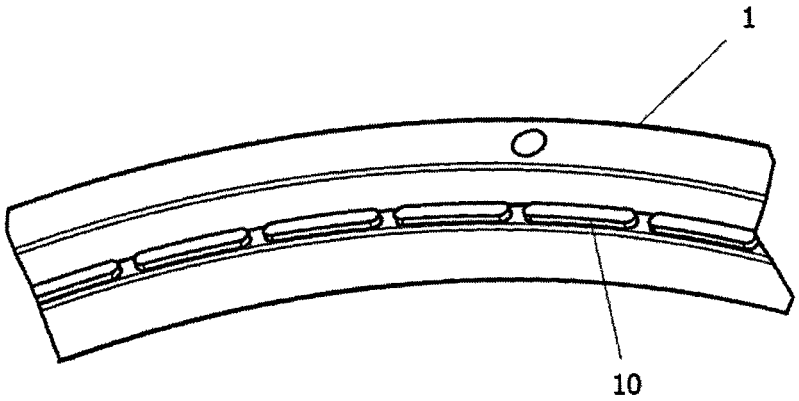
FIG. 9A shows a detailed view of an alternative embodiment of piston 10.

The pistons 10 are shown with a circular form, but other geometric shapes may be applied. For instance, the pistons 10 may be formed with a larger abutment surface (see FIG. 9A) against the ring 15 of the resonant skin.

Figure 10:
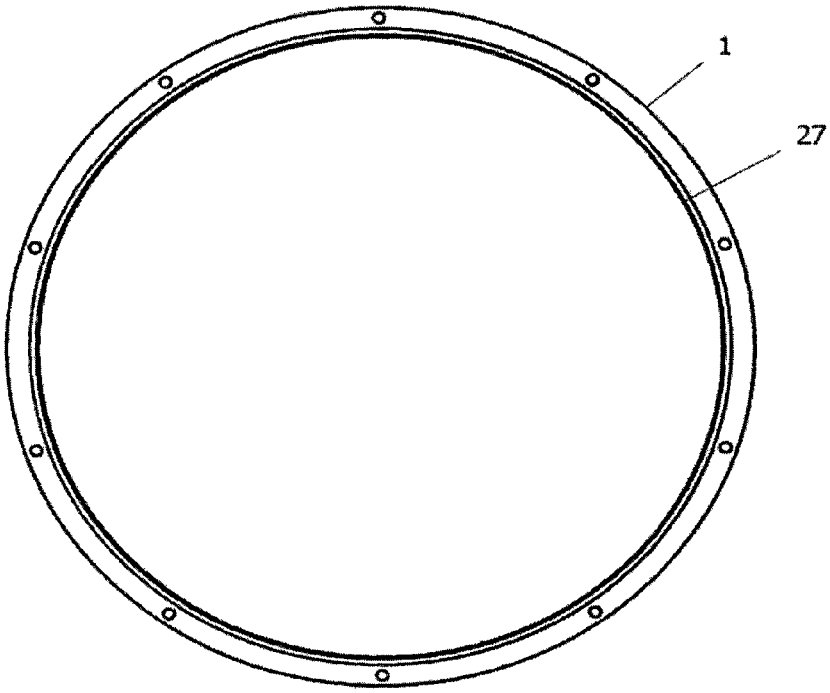
FIG. 10 shows the tension adjustment hoop 1 with one single annular piston 27.
Figure 10A:
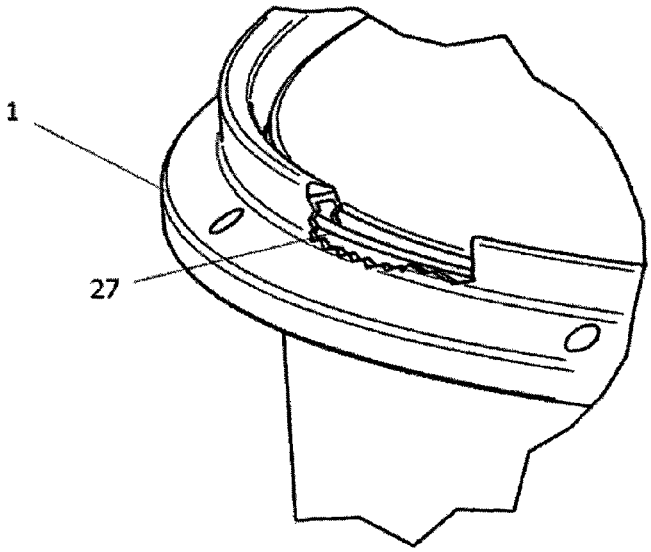
FIG. 10A shows a perspective view with a section of the tension adjustment hoop 1, showing the piston 27.

According to a second embodiment, the plurality of pistons 10 can be reduced to a single annular hydraulically acting piston 27 (FIGS. 10 and 10A).

Figure 2:
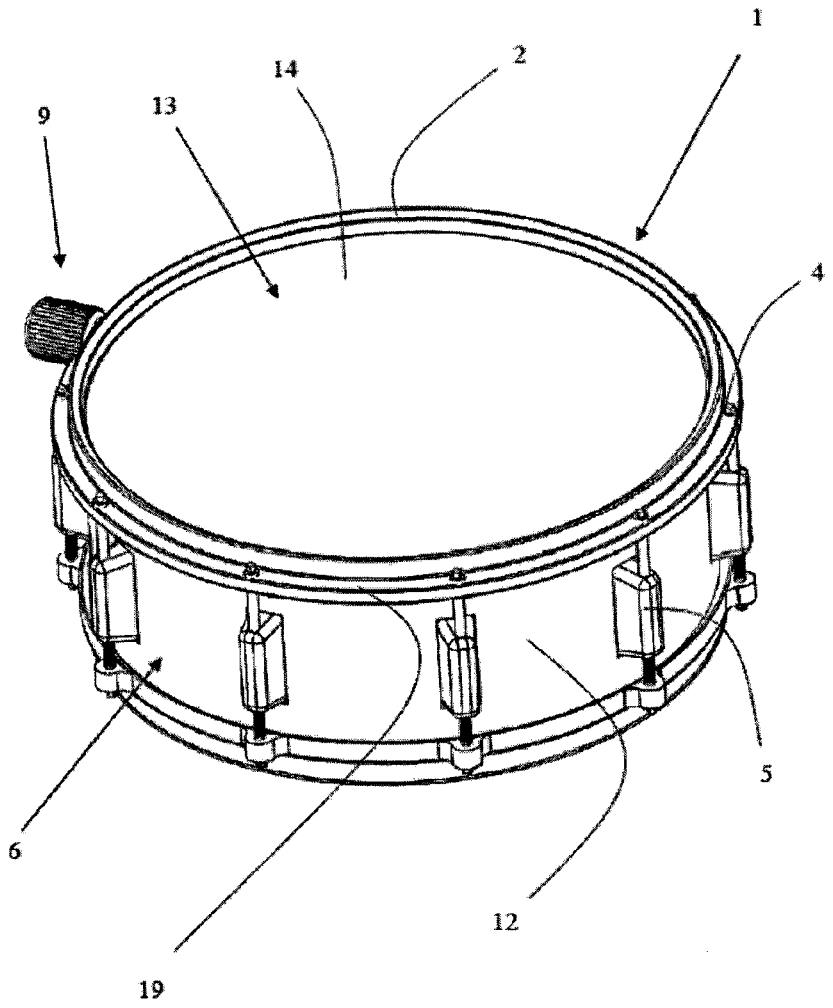
FIG. 2 shows an isometric view of a drum with the tension adjustment hoop of FIG. 1.

FIG. 2 shows an isometric view of a percussion instrument in the form of a drum 6 with the tension adjustment hoop 1 of FIG. 1.

The drum 6 comprises a shell 12 with coupling means 5. A resonant skin 13 comprising a skin 14 attached to a ring 15 (see FIGS. 4B and 4B) is mounted on the shell 12. The tension adjustment hoop 1 is located above the resonant skin 13. The coupling means 5 are connected to the retention means 4.

Figure 3:
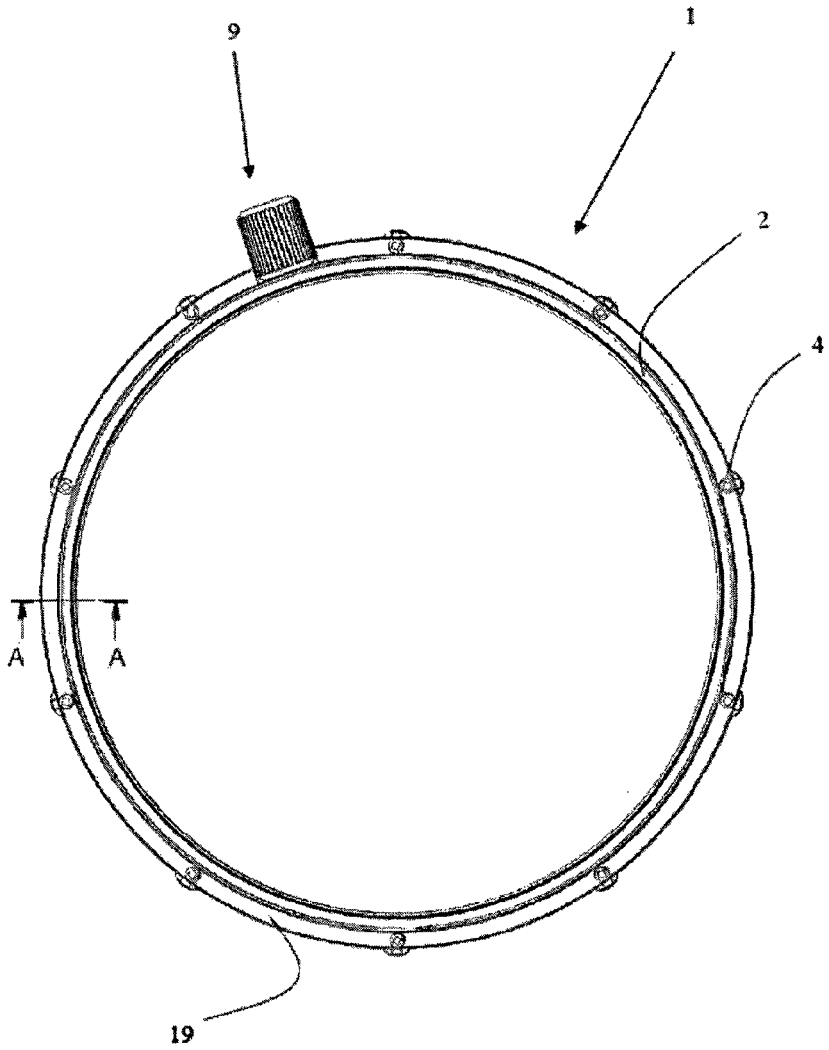
FIG. 3 shows a plan view of the drum of FIG. 2 with indication of section A-A.

FIG. 3 shows a plan view of the drum 6 of FIG. 2 with indication of section A-A.

Figure 4A:
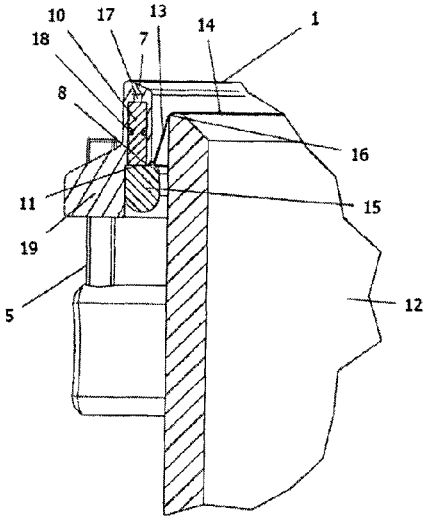
FIG. 4A shows section A-A of FIG. 3 through the tension adjustment hoop with the pistons in their first extreme position.

FIG. 4A shows section A-A of FIG. 3 through the tension adjustment hoop 1 with the pistons 10 in their first extreme position, The skin 14 abuts the end edge 16 of the shell 12. The bottom side 8 of the tension adjustment hoop labuts the ring 15 of the resonant skin 13.

The tension adjustment hoop 1 has an inner fluid channel 17. The pressure adjustment means 9 as well as each piston 10 are in hydraulic connection with the fluid channel 17. Each piston 10 is provided with a packing means 18, e.g. in the form of an O-ring.

Figure 4B:
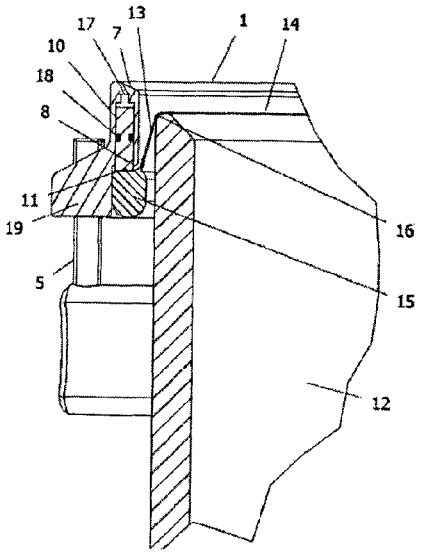
FIG. 4B shows section A-A of FIG. 3 through the tension adjustment hoop with the pistons displaced towards their second extreme position.

It is evident from FIGS. 4A and 4B that the tension adjustment hoop 1 has a flange 19. The coupling means 5 are attached to retention means 4 in the form of holes in the flange 19.

FIG. 4B shows section A-A of FIG. 3 through the tension adjustment hoop 1 with the pistons 10 displaced towards their second extreme position.

The hydraulic connection between the pressure adjustment means 9 and the pistons 10 through the fluid channel 17 means that the pistons 10 are displaced outwards from the bottom side 8 when the pressure in the fluid channel 17 increases, and are displaced back towards the tension adjustment hoop 1 when the pressure decreases.

In FIG. 4B, the pistons 10 are displaced beyond the bottom side 8 of the tension adjustment hoop 1, so that the skin 14 is tighter in FIG. 4B than in FIG. 4A.

Figure 5A:
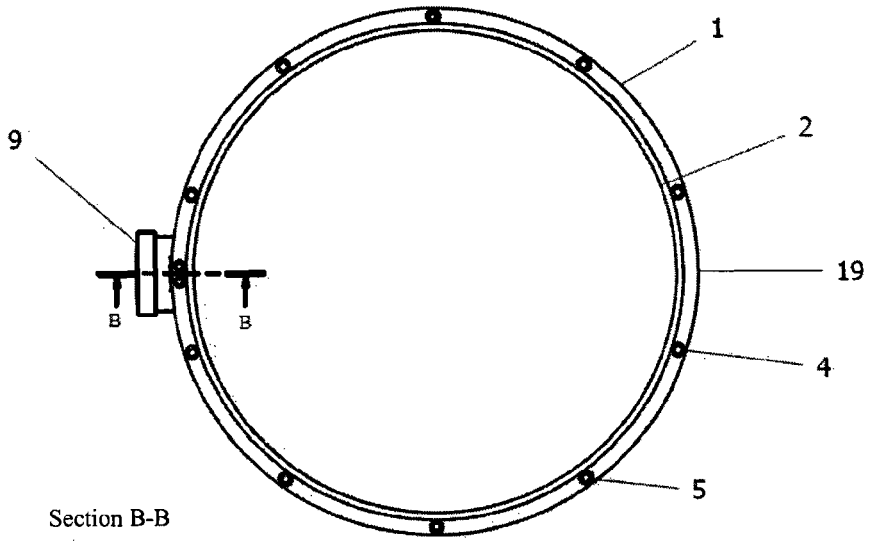
FIG. 5A shows a plan view of the tension adjustment hoop of FIG. 1 with indication of section B-B.

FIG. 5A shows a plan view of the tension adjustment hoop 1 of FIG. 1 with indication of section B-B.

Figure 5B:
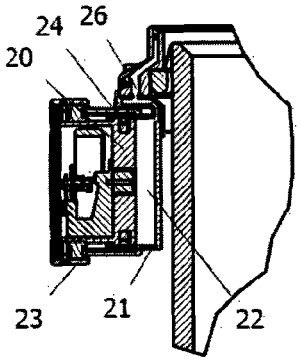
FIG. 5B shows section B-B of FIG. 5A through the tension adjustment hoop.
Figure 5C:
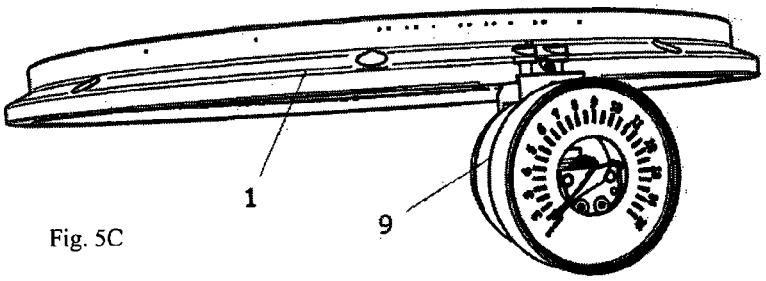
FIG. 5C shows a perspective view of the tension adjustment hoop of FIG. 1 with a pressure gauge being integrated in the pressure adjustment means.

FIG. 5B shows section B-B of FIG. 5A through the tension adjustment hoop 1. Section B-B passes through the pressure adjustment means 9.

The pressure adjustment means 9 is connected to the fluid channel 17 via a pressure adjustment connection 26.

The pressure adjustment means 9 comprises a pressure adjustment piston 20, which is displaceably mounted in a piston housing 21 with an adjustment volume 22, the pressure adjustment piston 20 being displaceable between a first adjustment position and a second adjustment position.

Furthermore, the pressure adjustment means 9 comprises a threaded actuating part 23. Screwing the actuating part 23 displaces the pressure adjustment piston 20. This achieves a pressure boost or pressure drop in the fluid channel 17 and a derived displacement of the pistons 10.

The pressure adjustment piston 20 is provided with a second packing means 24, preventing leaks from the fluid channel 17 to the surroundings.

Figure 6:
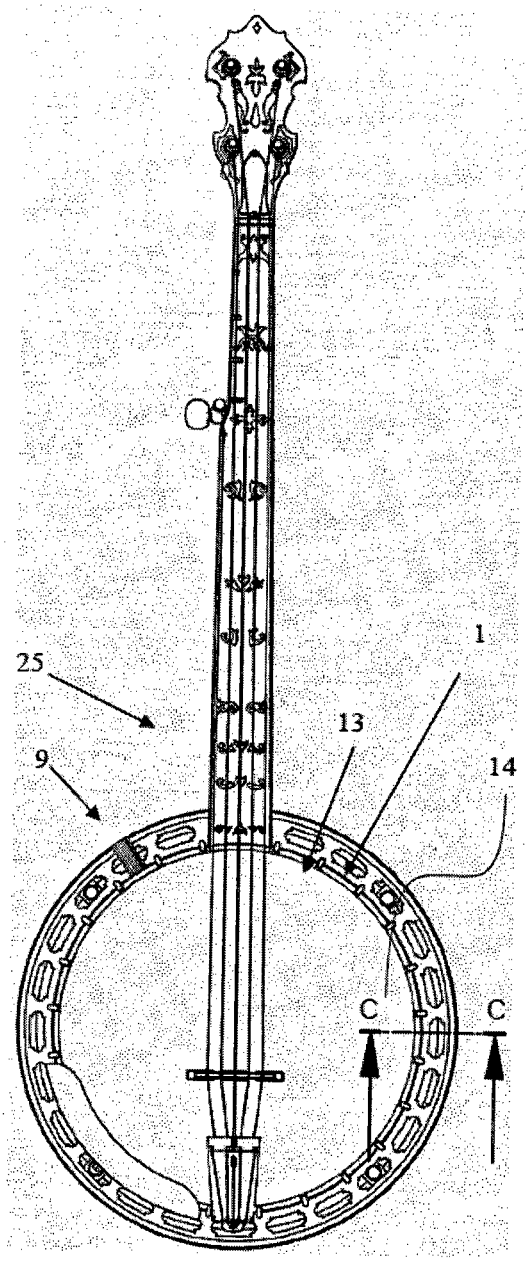
FIG. 6 shows a plan view of a banjo with the tension adjustment hoop of FIG. 1 with indication of section C-C.

FIG. 6 shows a plan view of a banjo 25 with the tension adjustment hoop 1 of FIG. 1 with indication of section C-C.

Figure 7:
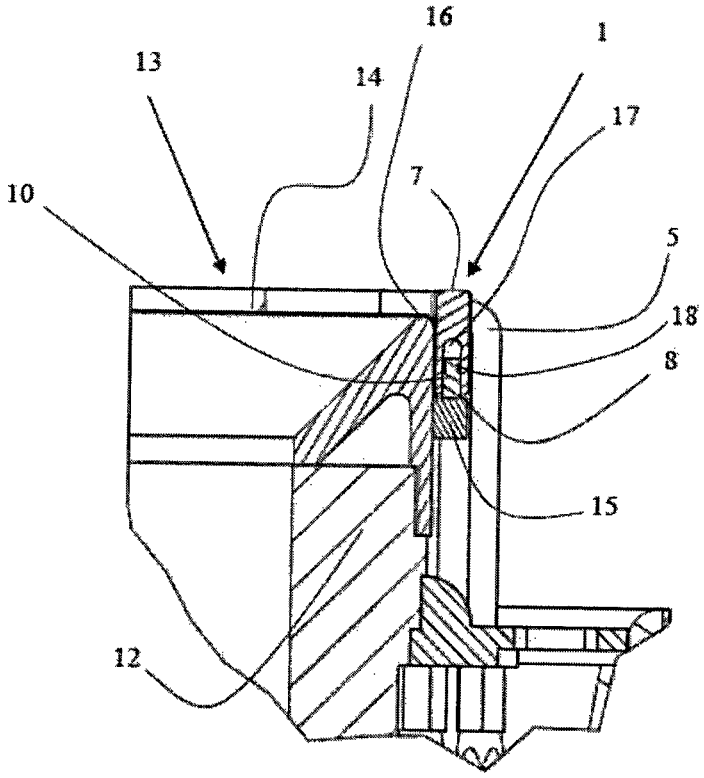
FIG. 7 shows section C-C of FIG. 6 through the tension adjustment hoop.
Figure 8A:
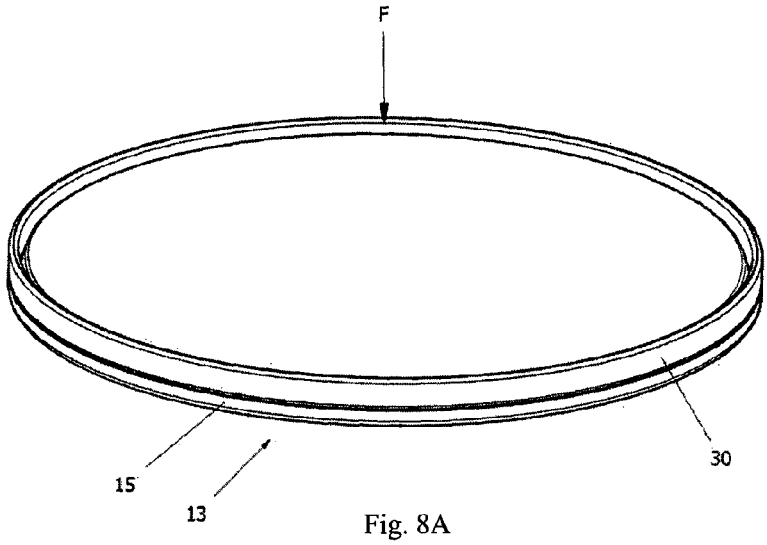
FIG. 8A shows a circularly coherent pressure means.
Figure 8B:
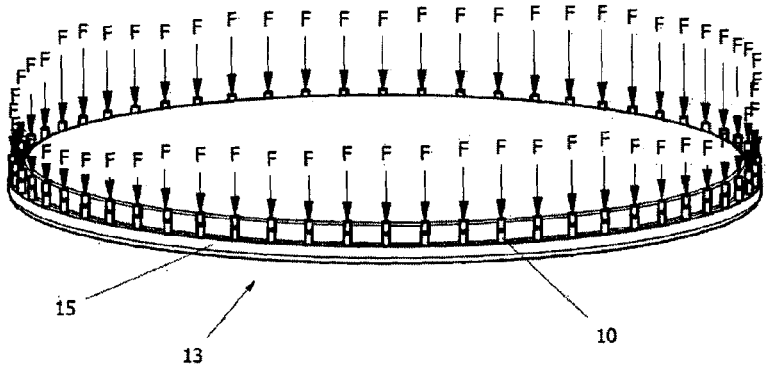
FIG. 8B shows a plurality of pressure means embodied as pistons 10.

FIG. 7 shows section C-C of FIG. 6 through the tension adjustment hoop 1.

The skin 14 abuts the end edge 16 of the shell. The bottom side 8 of the tension adjustment hoop abuts the ring 15 of the resonant skin.

The tension adjustment hoop 1 has an inner fluid channel 17. The pressure adjustment means 9 as well as each piston 10 are in hydraulic connection with the fluid channel 17. Each piston 10 is provided with a packing means 18, e.g. in the form of an O-ring.

The hydraulic connection between the pressure adjustment means 9 and the pistons 10 through the fluid channel 17 means that the pistons 10 are displaced outwards from the bottom side 8 when the pressure in the fluid channel 17 increases, and are displaced back towards the tension adjustment hoop 1 when the pressure decreases.

Alternatively, the packing means may be an integrated part of the piston. For instance, the integrated piston may be made from rubber or another material suited for packing, which may also transfer the required pressure to the ring of the resonant skin.

The invention claimed is:

1. A tension adjustment hoop for tensioning a resonant skin with a ring on a musical instrument, the tension adjustment hoop being formed by a ring with a centre axis and with retention means arranged to interact with coupling means on the musical instrument for retention of the tension adjustment hoop, the tension adjustment hoop having an opposing top side and bottom side, wherein the tension adjustment hoop comprises an inner fluid channel, provided with a pressure adjustment connection in hydraulic connection with the fluid channel, and a plurality of pistons, each in hydraulic connection with the fluid channel, each with a free end opposite the fluid channel, each positioned for abutting a ring of a resonant skin of a musical instrument, and each, under the influence of the pressure in the fluid channel, being displaceable in a direction parallel to the centre axis of the tension adjustment hoop between a first extreme position, where the free end is level with the bottom side, and a second extreme position, where the free end is outside the bottom side.

2. A tension adjustment hoop according to claim 1, wherein the tension adjustment hoop comprises a flange and wherein retention means are formed through openings in the flange.

3. A tension adjustment hoop according to claim 1, wherein the tension adjustment hoop comprises a pressure adjustment means in connection with the pressure adjustment connection for adjustment of the pressure in the fluid channel.

4. A tension adjustment hoop according to claim 3, wherein the pressure adjustment means comprises a pressure adjustment piston displaceably mounted in a piston housing with an adjustment volume, the pressure adjustment piston being displaceable between a first adjustment position and a second adjustment position, where the adjustment volume is the largest with the pressure adjustment piston in its first adjustment position, and where the adjustment volume is the smallest with the pressure adjustment piston in its second adjustment position.

5. A tension adjustment hoop according to claim 4, wherein the pressure adjustment means comprises a threaded actuating part for displacement of the pressure adjustment piston.

6. A method for tensioning a musical instrument using the tension adjustment hoop according to claim 1, the method comprising the steps of:

mounting the tension adjustment hoop on a musical instrument;

coupling the retention means to the coupling means on the musical instrument;

aligning the tension adjustment hoop by adjusting the coupling means; and adjusting the pressure in the fluid channel to adjust a pitch of the resonant skin.

7. A method for tensioning a musical instrument using the tension adjustment hoop according to claim 1, the method including mounting the tension adjustment hoop on a musical instrument and tensioning a resonant skin on the musical instrument, wherein the musical instrument is a percussion instrument or a string instrument.

8. A method for tensioning a musical instrument using the tension adjustment hoop according to claim 7, the method including mounting the tension adjustment hoop on a musical instrument in combination with an external actuating part, the external actuating part being in connection with the pressure adjustment connection.

9. A method for tensioning a musical instrument using the tension adjustment hoop according to claim 6, wherein the step of mounting includes mounting the tension adjustment hoop on a drumhead.

* * * * *